United States Patent [19]

Agner

[11] Patent Number: 4,941,855

[45] Date of Patent: Jul. 17, 1990

[54] OARLOCK

[76] Inventor: Hugh R. Agner, 30834 Jennie La., Burlington, Wis. 53105

[21] Appl. No.: 276,696

[22] Filed: Nov. 28, 1988

[51] Int. Cl.[5] ..... B63H 16/04

[52] U.S. Cl. ..... 440/104; 440/106

[58] Field of Search ..... 440/101, 104, 110; 416/24; 248/278

[56] References Cited

U.S. PATENT DOCUMENTS

| | | | |
|---|---|---|---|
| 551,265 | 12/1895 | DeRiar | 440/106 |
| 741,850 | 10/1903 | Supple | 440/106 |
| 1,357,111 | 10/1920 | O'Neill | 440/107 |
| 1,721,665 | 7/1929 | Landberg | 440/109 |
| 2,519,621 | 8/1950 | Agner | 440/106 |
| 2,657,401 | 11/1953 | Goserud | 440/107 |

FOREIGN PATENT DOCUMENTS

| | | | |
|---|---|---|---|
| 793003 | 1/1936 | France | 440/106 |
| 9595 | of 1891 | United Kingdom | 440/106 |

*Primary Examiner*—Sherman D. Basinger
*Assistant Examiner*—Edwin L. Swinehart
*Attorney, Agent, or Firm*—Michael, Best & Friedrich

[57] ABSTRACT

An oarlock comprising a pin adapted to be mounted for pivotal movement about a generally vertical axis, the pin including an upwardly facing surface and an upper portion located above the surface, and an oar supporting member mounted on the upper portion of the pin for pivotal movement relative thereto about a generally horizontal axis the oar supporting member including a lower end surface located above the upwardly facing surface of the pin, the lower end surface including a portion which is spaced from the upwardly facing surface so as to permit pivotal movement of the oar supporting member about the horizontal axis, and a portion which engages the upwardly facing surface in response to pivotal movement of the oar supporting member so as to limit pivotal movement of the oar supporting member about the horizontal axis.

18 Claims, 1 Drawing Sheet

OARLOCK

BACKGROUND OF THE INVENTION

The invention relates to oarlocks.

A typical oarlock comprises a pin which is received in a vertical aperture or oarwell for pivotal movement about a generally vertical axis. The oarlock also includes a clamp member mounted on the upper end of the pin for pivotal movement relative to the pin about a generally horizontal axis. The clamp member supports an oar so that pivotal movement of the pin and clamp member about the vertical axis causes back and forth movement of the paddle portion of the oar, and pivotal movement of the clamp member about the horizontal axis causes up and down movement of the paddle portion of the oar.

The paddle portion of the oar should not be raised above a certain high point above the surface of the water and should not be lowered below a certain low point below the surface of the water. Movement of the paddle portion above this high point or below this low point is unnecessary and results in wasted energy and undesirable stress on the oar.

U.S Agner Pat. No. 2,519,621 discloses an oarlock wherein pivotal movement of the oar about the horizontal pivot axis is limited by a slot 3' that receives a clamping bolt 8. This arrangement is effective but is somewhat complex. U.S. DeRiar Pat. No. 551,265 discloses an oarlock including a ball and socket joint. Although DeRiar does not describe his oarlock as limiting pivotal movement of the oar about the horizontal pivot axis, this would be an inherent function of the ball and socket joint. The ball and socket joint, however, has its own disadvantages and is also somewhat complex.

SUMMARY OF THE INVENTION

The invention provides an oarlock comprising an extremely simple arrangement for limiting pivotal movement of the oar about the horizontal pivot axis. More particularly, the oarlock comprises a pin adapted to be mounted for pivotal movement about a generally vertical axis. The pin includes an annular shoulder defining an annular, upwardly facing surface, and the pin also includes an upper portion located above the upwardly facing surface. The oarlock also comprises an oar supporting or clamping member mounted on the upper portion of the pin, via a nut and bolt, for pivotal movement relative to the pin about a generally horizontal axis. The clamping member includes opposite clamping halves that grip opposite sides of the oar, as is known in the art.

Each of the clamping halves includes a lower end surface located above the upwardly facing surface of the pin. The lower surface includes a lowermost, central portion which is spaced from the upwardly facing surface of the pin so as to permit pivotal movement of the clamping member about the horizontal axis. The lower surface also includes a portion which is located o one side of the central portion and which engages the upwardly facing surface on the pin in response to pivotal movement of the clamping member in one direction so as to limit pivotal movement of the clamping member (and of the oar) in the one direction about the horizontal pivot axis. The lower surface also includes a portion which is located on the other side of the central portion and which engages the upwardly facing surface in response to pivotal movement of the clamping member in the opposite direction and beyond the above-mentioned range so as to limit pivotal movement of the clamping member in the opposite direction about the horizontal pivot axis. In the preferred embodiment, the three portions of the lower end surface are substantially planar or flat, and the two side portions make plane contact with the upwardly facing surface when they engage the upwardly facing surface. Additionally, the two side portions extend at angles of approximately 45° relative to the central portion.

Thus, the one portion of the lower end surface limits downward movement of the paddle portion of the oar, and the other portion of the lower end surface limits upward movement of the paddle portion of the oar.

Instead of requiring a complicated construction such as that disclosed in the above-mentioned Agner patent, the arrangement provided by the invention requires only that the above-described lower end surface be machined on the lower end of the clamping member.

Other features and advantages of the invention will become apparent to those skilled in the art upon review of the following detailed description, claims and drawings.

Figure 1:
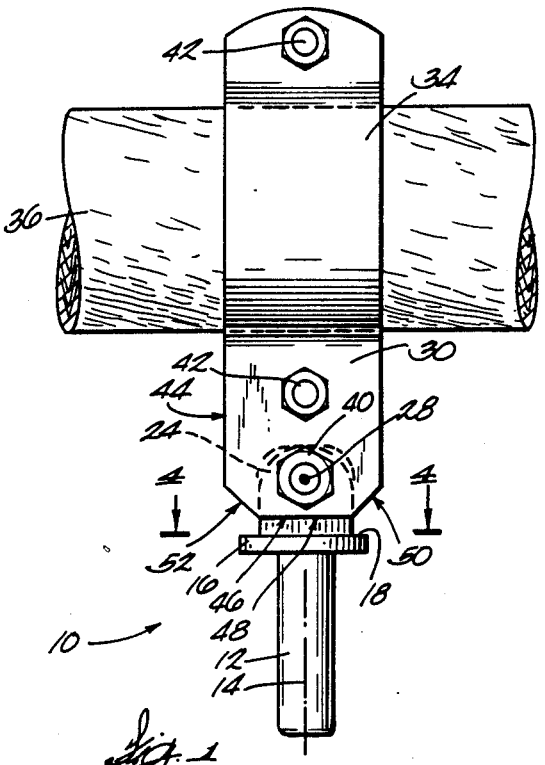
FIG. 1 is a side elevational view of an oarlock embodying the invention and supporting an oar in the horizontal position.
Figure 2:
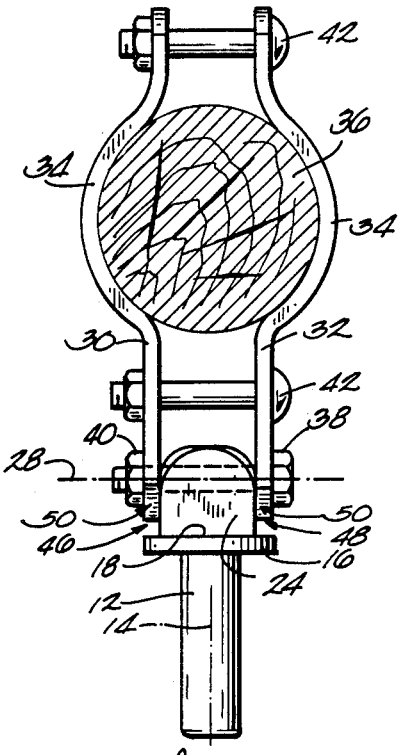
FIG. 2 is an end elevational view of the oarlock.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Figure 4:
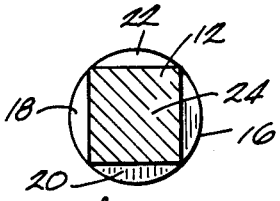
FIG. 4 is a view taken along line 4—4 in FIG. 1.

An oarlock 10 embodying the invention is illustrated in the drawings. The oarlock 10 comprises a pin 12 adapted to be mounted in a vertically extending aperture (not shown), such as an aperture in an oarwell or in the gunwhale of a boat, for pivotal movement about a generally vertical axis 14. The pin 12 includes an annular shoulder 16 defining a substantially annular, substantially horizontal, upwardly facing surface 18 having (see FIG. 4) diametrically opposed portions 20 and 22. The pin 12 also includes an upper portion 24 located above the surface 18.

The oarlock 10 also comprises an oar supporting or clamping member 26 mounted on the upper portion 24 of the pin 12 for pivotal movement relative thereto about a generally horizontal axis 28. In the preferred embodiment, the clamping member 26 includes opposite clamping halves 30 and 32 including opposed arcuate portions 34 gripping opposite sides of an oar 36 (partially shown). The clamping halves 30 and 32 are pivotally mounted on the upper portion 24 of the pin 12 by a bolt 38 extending along the axis 28 and by a nut 40 fixed on one end of the bolt 38. The clamping halves 30 and 32 are tightened around the oar 36 by upper and lower nut and bolt assemblies 42. The clamping halves 30 and 32 are substantially identical, except for being mirror images of each other, and only the clamping half 30 will be described in detail. Common elements of the clamping halves 30 and 32 have been given the same reference numerals.

The clamping half 30 has a periphery 44 including a lower end surface 46 located above the upwardly facing surface 18 of the pin 12. The lower end surface 46 includes a lowermost, central portion 48 which is spaced from the upwardly facing surface 18 so as to permit pivotal movement of the clamping half 30 about the horizontal axis 28. In the preferred embodiment, the central portion 48 of the lower end surface 46 is substantially flat or planar and extends horizontally when the oar 36 is in its horizontal position, as shown in FIG. 1.

Figure 3:
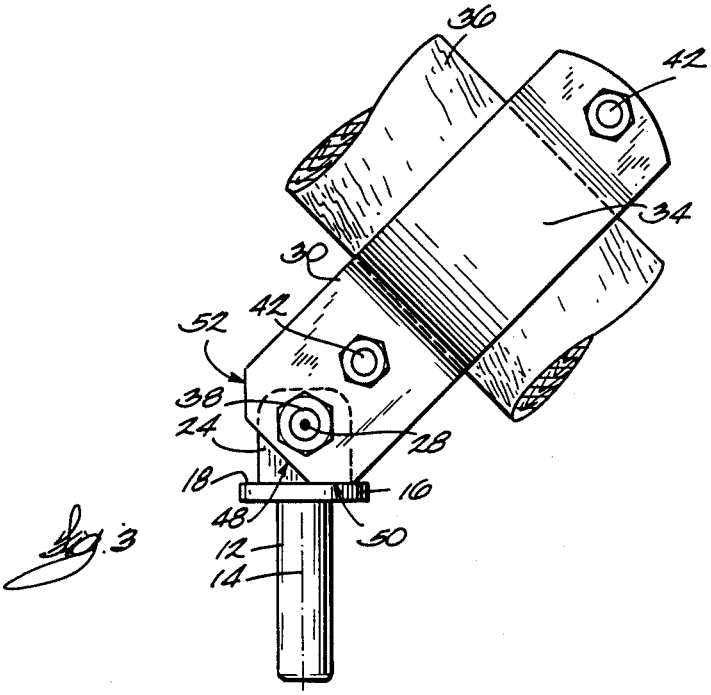
FIG. 3 is a view similar to FIG. 1 and showing the oarlock supporting the oar in a tilted position.

The lower end surface 46 also includes a right or first side portion 50 which is located on one side of the central portion 48 (to the right in FIG. 1) and which engages the upwardly facing surface 18 in response to pivotal movement of the clamping member 26 in one direction (clockwise in FIG. 1) and about the axis 28 so as to limit clockwise pivotal movement of the clamping member 26 about the axis 28. In the illustrated construction, the right portion 50 of the lower end surface 46 is substantially flat or planar and extends at an angle of approximately 45° relative to the central portion 48. Furthermore, as shown in FIG. 3, the right surface portion 50 is preferably formed so that the right surface portion 50 makes plane contact with or squarely abuts the upwardly facing surface 18 to limit pivotal movement of the clamping member 26.

The lower end surface 46 also includes a left or second side portion 52 which engages the upwardly facing surface 18 in response to pivotal movement of the clamping half 30 in the opposite direction (counterclockwise in FIG. 1) and about the axis 28 so as to limit counterclockwise pivotal movement of the clamping member 26 about the axis 28. In the preferred embodiment, the left surface portion 52, like the right surface portion 50, is substantially flat and extends at an angle of approximately 45° relative to the central surface portion 48. Also, the left surface portion 52 is preferably formed so that the left surface portion 52 makes plane contact with or squarely abuts the upwardly facing surface 18 to limit pivotal movement of the clamping member 26.

The right and left surface portions 50 and 52 of the clamping half 30 engage the portion 20 of the upwardly facing surface 18, and the right and left surface portions 50 and 52 of the clamping half 32 engage the portion 22 of the upwardly facing surface 18. Assuming the paddle portion (not shown) of the oar 36 is located to the right in FIG. 1, downward movement of the paddle portion is limited by engagement of the right surface portion 50 with the upwardly facing surface 18, and upward movement of the paddle portion is limited by engagement of the left surface portion 52 with the upwardly facing surface 18. In the preferred embodiment, the surface portions 50 and 52 permit movement of the clamping member 26, and therefore of the oar 36, through an angular range of approximately 90°.

It should be understood that in alternative embodiments the surface portions 48, 50 and 52 need not be planar. For example, any one or all of the surface portions 48, 50 and 52 could be arcuate. Alternatively, the surface portions 50 and 52 could simply be points or lines on the lower end surface 46. Thus, the entire lower end surface could be a planar, rectangular surface which extends horizontally when the oar 36 is in its horizontal position, with the opposite ends of the planar surface constituting the surface portions 50 and 52 and with the remainder of the planar surface constituting the central portion 48.

Various features of the invention are set forth in the following claims.

I claim:

1. An oarlock comprising a pin adapted to be mounted for pivotal movement about a generally vertical axis, said pin including a generally horizontal, upwardly facing surface and an upper portion located above said surface, and an oar supporting member mounted on said upper portion of said pin for pivotal movement relative thereto about a generally horizontal axis, said member including opposite clamping halves and means for clamping said halves around an oar, and said member having a periphery including a portion which engages said upwardly facing surface in response to pivotal movement of said member in one direction and about said horizontal axis so as to limit pivotal movement of said member in said one direction.

2. An oarlock as set forth in claim 1 wherein said periphery also includes a second portion which engages said upwardly facing surface in response to pivotal movement of said member in the other direction and about said horizontal axis so as to limit pivotal movement of said member in said other direction.

3. An oarlock as set forth in claim 1 wherein each of said clamping halves has a periphery including the above-mentioned portion.

4. An oarlock as set forth in claim 3 wherein said pin includes an annular shoulder defining said upwardly facing surface, wherein said upwardly facing surface has diametrically opposed portions, wherein said portion of said periphery of one of said clamping halves engages one of said portions of said surface, and wherein said portion of said periphery of the other of said clamping halves engages the other of said portions of said upwardly facing surface.

5. An oarlock comprising a pin adapted to be mounted for pivotal movement about a generally vertical axis, said pin including a substantially planar, upwardly facing surface and an upper portion located above said surface, and an oar supporting member mounted on said upper portion of said pin for pivotal movement relative thereto about a generally horizontal axis, said member having a periphery including a substantially planar portion which engages said upwardly facing surface in response to pivotal movement of said member in one direction and about said horizontal axis so as to limit pivotal movement of said member in said one direction and which makes plane contact with said upwardly facing surface when said portion of said periphery engages said upwardly facing surface.

6. An oarlock comprising a pin adapted to be mounted for pivotal movement about a generally vertical axis, said pin including an annular shoulder defining a substantially planar surface having diametrically opposed portions, and an oar supporting member mounted on said pin for pivotal movement relative thereto about a generally horizontal axis, said member including opposite clamping halves each having a substantially planar surface which makes plane contact with said surface on said pin in response to pivotal movement of said member in one direction and about said horizontal axis so as to limit pivotal movement of said member in said one direction, said surface on one of said clamping halves engaging one of said portions of said surface on said pin, and said surface on the other of said clamping halves engaging the other of said portions of said surface on said pin, and said oar supporting member also including means for clamping said halves around an oar.

7. An oarlock comprising a pin adapted to be mounted for pivotal movement about a generally vertical axis, said pin including a generally horizontal, upwardly facing surface and an upper portion located above said surface, and an oar supporting member mounted on said upper portion of said pin for pivotal movement relative thereto about a generally horizontal axis, said member including opposite clamping halves and means for clamping said halves around an oar, and said member also including a lower end surface located above said upwardly facing surface of said pin, said lower end surface including a portion which is spaced from said upwardly facing surface so as to permit pivotal movement of said member about said horizontal axis, and a portion which engages said upwardly facing surface in response to pivotal movement of said member in one direction and about said horizontal axis so as to limit pivotal movement of said member in said one direction.

8. An oarlock as set forth in claim 7 wherein said lower end surface also includes a third portion which engages said upwardly facing surface in response to pivotal movement of said member in the other direction and about said horizontal axis so as to limit pivotal movement of said member in said other direction.

9. An oarlock as set forth in claim 7 wherein each of said clamping halves has a periphery including the above-mentioned portion.

10. An oarlock comprising a pin adapted to be mounted for pivotal movement about a generally vertical axis, said pin including an annular shoulder defining an upwardly facing surface having diametrically opposed portions, and an upper portion located above said surface, and an oar supporting member mounted on said upper portion of said pin for pivotal movement relative thereto about a generally horizontal axis, said member including a lower end surface located above said upwardly facing surface of said pin, said lower end surface including a portion which is spaced from said upwardly facing surface so as to permit pivotal movement of said member about said horizontal axis, and opposite clamping halves each including a periphery having a portion which engages said upwardly facing surface in response to pivotal movement of said member in one direction and about said horizontal axis so as to limit pivotal movement of said member in said one direction, wherein said portion of said periphery of one of said clamping halves engages one of said portions of said upwardly facing surface, and wherein said portion of said periphery of the other of said clamping halves engages the other of said portions of said upwardly facing surface, and said oar supporting member also including means for clamping said halves around an oar.

11. An oarlock as set forth in claim 10 wherein said upwardly facing surface is substantially planar, and wherein said surface portion is substantially planar and makes plane contact with said upwardly facing surface when said surface portion engages said upwardly facing surface.

12. An oarlock comprising a pin adapted to be mounted for pivotal movement about a generally vertical axis, said pin including a substantially planar, upwardly facing surface and an upper portion located above said surface, and an oar supporting member mounted on said upper portion of said pin for pivotal movement relative thereto about a generally horizontal axis, said member including a lower end surface located above said upwardly facing surface of said pin, said lower end surface including a portion which is spaced from said upwardly facing surface so as to permit pivotal movement of said member about said horizontal axis, and a substantially planar portion which engages said upwardly facing surface in response to pivotal movement of said member in one direction and about said horizontal axis so as to limit pivotal movement of said member in said one direction, said substantially planar surface portion making plane contact with said upwardly facing surface when said surface portion engages said upwardly facing surface.

13. An oarlock comprising a pin adapted to be mounted for pivotal movement about a generally vertical axis, said pin including a substantially planar surface, and an oar supporting member mounted on said pin for pivotal movement relative thereto about a generally horizontal axis, said member including a substantially planar surface which makes plane contact with said surface on said pin in response to pivotal movement of said member in one direction and about said horizontal axis so as to limit pivotal movement of said member in said one direction.

14. An oarlock as set forth in claim 13 wherein said member also includes a second substantially planar surface which makes plane contact with said surface on said pin in response to pivotal movement of said member in the other direction and about said horizontal axis so as to limit pivotal movement of said member in said other direction.

15. An oarlock as set forth in claim 13 wherein said oar supporting member includes opposite clamping halves, and means for clamping said halves around an oar.

16. An oarlock as set forth in claim 15 wherein each of said clamping halves includes the above-mentioned surface.

17. An oarlock comprising a pin adapted to be mounted for pivotal movement about a generally vertical axis, said pin including an annular shoulder defining an upwardly facing surface having diametrically opposed portions, and said pin including an upper portion located above said surface, and an oar supporting member mounted on said upper portion of said pin for pivotal movement relative thereto about a generally horizontal axis, said member including opposite clamping halves each having a periphery including a portion which engages said upwardly facing surface in response to pivotal movement of said member in one direction and about said horizontal axis so as to limit pivotal movement of said member in said one direction, said portion of said periphery of one of said clamping halves engaging one of said portions of said surface, and said portion of said periphery of the other of said clamping halves engaging the other of said portions of said surface, and said oar supporting member also including means for clamping said halves around an oar.

18. An oarlock as set forth in claim 17 wherein said upwardly facing surface is substantially planar, and wherein said portion of said periphery is substantially planar and makes plane contact with said upwardly facing surface when said portion of said periphery engages said upwardly facing surface.

* * * * *